United States Patent [19]

Tyson

[11] 4,234,093

[45] Nov. 18, 1980

[54] PILL DISPENSER WITH SAFETY FEATURES

[76] Inventor: Raymond K. Tyson, 406 N. Carr Rd., Plainfield, Ind. 46168

[21] Appl. No.: 40,896

[22] Filed: May 21, 1979

[51] Int. Cl.[3] ..... B65D 83/04; B65D 85/56

[52] U.S. Cl. ..... 206/536; 220/8; 222/520

[58] Field of Search ..... 206/533, 536, 540, 270, 206/1.5; 220/8; 222/520

[56] References Cited

U.S. PATENT DOCUMENTS

| | | | |
|---|---|---|---|
| 733,701 | 7/1903 | Dalton | 222/520 |
| 781,527 | 1/1905 | Jeffers, Jr. | 206/536 |
| 2,423,901 | 7/1947 | Perkins | 220/8 |
| 2,992,763 | 7/1961 | Huertas | 222/520 |

*Primary Examiner*—William T. Dixson, Jr.

*Attorney, Agent, or Firm*—Woodard, Weikart, Emhardt & Naughton

[57] ABSTRACT

A safety container for containing and dispensing particulate matter such as pills and the like. Two members have concentric, cylindrical walls which are slidably engaged with each other, and have oppositely disposed end walls to form an enclosure. Sliding engagement and movement is in both a longitudinal and transverse direction creating registration of two apertures in order to obtain access to the contents of the container. Tabs, projecting from the end walls, are used to grip the safety container and prevent the container from being set down unless it is in a closed position.

10 Claims, 2 Drawing Figures

PILL DISPENSER WITH SAFETY FEATURES

BACKGROUND OF THE INVENTION

1. Field of the Invention:

The field of the invention relates to containers for particulate matter such as pills and the like. More particularly to such containers which incorporate novel opening means which help to prevent their unsupervised and undesired opening by small children as well as provide for ease of use by the elderly and visually impaired persons.

2. Description of the Prior Art:

Most medicinal pills are unsafe except when taken as prescribed. However when small children obtain unsupervised access to such pills they typically ingest the pills, often resulting in serious illness and on occasion causing death. It is, therefore, desirable for pill containers to incorporate some means of preventing their unsupervised opening by small children.

Of further concern are the difficulties encountered by the visually impaired and the elderly. Blind people often have difficulty in dispensing the desired number of pills from a container. Tipping the container at an angle and shaking often causes a number of pills to come out of the container at once instead of one or two at a time. This is inconvenient for people who can see, and the procedure of pouring the extra pills back into the container is very awkward for a blind person. Additionally, it is virtually impossible for a blind person to locate any pills which may have spilled onto the floor. Elderly people often have difficulty in opening safety containers because their opening usually requires some degree of physical strength or dexterity. The elderly also encounter the problems attendant with shaking an excessive number of pills from the container.

Various types of pill containers have been developed which deter in some way their opening by small children. Some of the devices which have been designed prevent unsupervised opening by requiring some type of special technique for opening which may additionally require a certain degree of physical strength of dexterity. U.S. Pat. No. 4,059,198 to Mumford discloses one such device which incorporates a safety cap that must be pressed down before turning to open. U.S. Pat. No. 3,844,407 to Buie is another child resistant container that requires a longitudinal compression prior to the twisting off of the cap. Other containers which require a special technique for opening are disclosed in U.S. Pat. No. 4,116,329 to Garden (a spring loaded and locking latch), an U.S. Pat. Nos. 3,828,961 and 3,912,073 to Lewis (multi-component arrangement of slots and engaging tabs).

Other devices utilize rotating discs which can be indexed to align apertures in the discs. U.S. Pat. No. 3,313,441 to Fadden discloses one such device which incorporates three discs having eccentric, registerable apertures. U.S. Pat. No. 3,860,111 to Thompson discloses another pill container utilizing the indexing aperture feature. In Thompson three tabs are placed in a particular configuration in order to align apertures in the discs. U.S. Pat. No. 3,563,368 to McHugh discloses another container in which apertures located on the top of the container are aligned to obtain access to the interior of the container.

U.S. Pat No. 3,871,522 to Feldman discloses a safety container in which a spring biased cap is rotatable to register an aperture in the cap with an aperture in the container. The spring mechanism of Feldman maintains the cap in a closed position unless it is rotated to the open position.

U.S. Pat. No. 3,399,764 to Rigor discloses a medicine bottle in which the cap is maintained in a closed position by two aligned permanent magnets. By twisting the cap in such a manner as to move the magnets away from alignment, the cap can be moved to an open position and removed.

U.S. Pat. No. 1,775,959 to Himes discloses a dispensing receptacle in which two complementary telescoping cylinders are moved longitudinally with respect to each other to align apertures. In British Pat. No. 473308, there is also disclosed a container which incorporates two complementary telescoping cylinders which slide longitudinally with respect to each other to create an opening.

SUMMARY OF THE INVENTION

In general terms, the present invention is a new and useful safety container in which two concentric, cylinders are slidably engaged and movable in both a longitudinal and a transverse direction to register two apertures. In some embodiments, grasping means project outwardly in such a manner so as to prevent the placement of the safety container on a flat horizontal surface unless the container is in a closed position.

The objects and advantages of the present invention will become more apparent in the following diagrams and detailed description of the preferred embodiment.

DESCRIPTION OF THE PREFERRED EMBODIMENT

Figure 1:
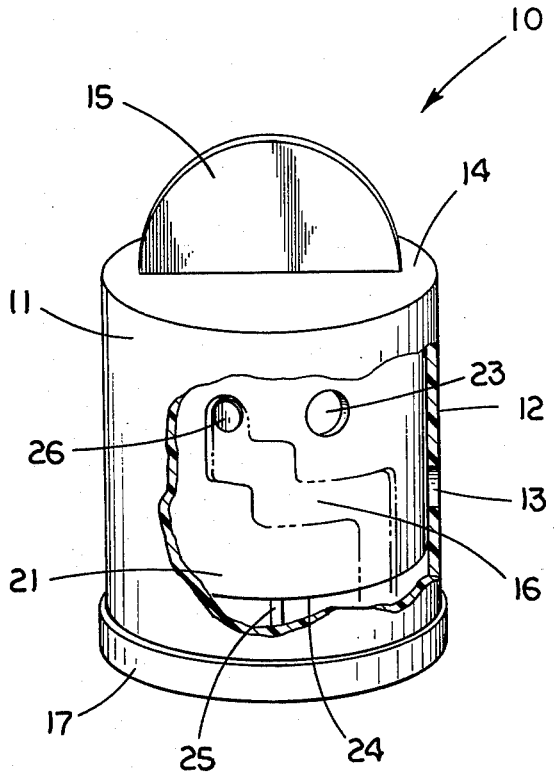
FIG. 1 is a fragmentary perspective view of the safety container of the present invention in a closed position.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
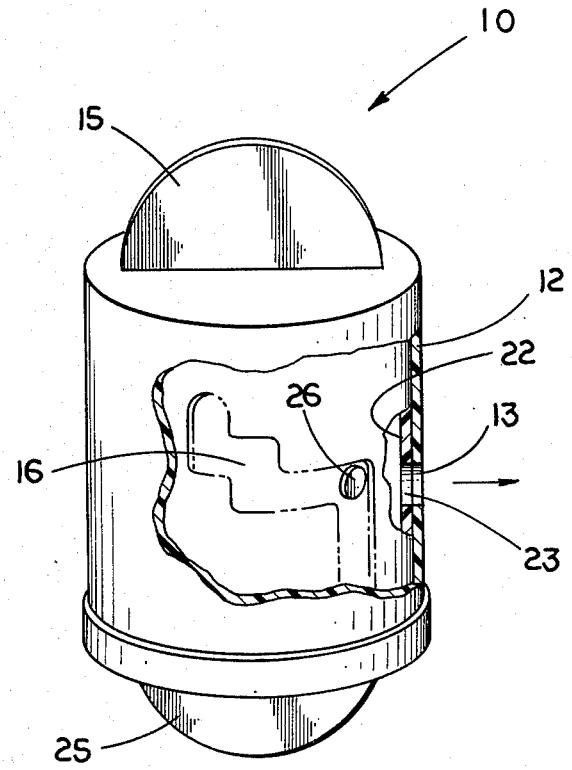
FIG. 2 is a fragmentary perspective view of the safety container of FIG. 1 in an open position.

In the preferred embodiment (see FIGS. 1 and 2) safety container 10 includes an exterior member 11 and an interior member 21. Exterior member 11 includes an end wall 14 and a cylindrical side wall 12. The cylindrical side wall 12 defines a circular exterior side wall aperture 13. Projection 15, forming the shape of a half disc projects outwardly from end wall 14 and is rigidly secured thereto along its diametric edge.

Interior member 21 includes an interior cylindrical side wall 22 which defines a circular interior side wall aperture 23. Interior member 21 also includes an interior end wall 24 which is oppositely disposed to the exterior member end wall 14 thereby completing an enclosure. A second outward projection 25, forming the shape of a half disc, projects outwardly from interior member end wall 24 and is rigidly secured thereto along its diametric edge.

Cylindrical side walls 12 and 22 are concentric and slidably engaged (the inside diameter of side wall 12 is slightly greater than the outside diameter of side wall 22) with each other and are movable, one with respect to the other, in both a longitudinal and a transverse direction such that the two apertures 13 and 23 can be registered with each other. The sliding movement follows a path defined by a recessed slotted portion 16, disposed in cylindrical side wall 12. Boss 26 protrudes from cylindrical side wall 22 and extends into recessed slotted portion 16 for following the path defined by recessed slotted portion 16. As boss 26 moves through the path defined by recessed slotted portion 16, aperture 23 is brought into alignment with aperture 13.

In the preferred embodiment, the path defined by recessed slotted portion 16 has three longitudinal portions which are interspersed by two transverse portions. However, it is not necessary that the path have only longitudinal and transverse portion nor must the turns in the path be right angles. But, it is preferred that there be at least two sharp turns in the path (60 degrees or more) and that the relative movement be generally in both a longitudinal and a transverse direction. Recessed slotted portion 16 has a depth of about ½ of the wall thickness of exterior member 12 and therefore boss 26 is not exposed to the exterior of the container.

Projections 15 and 25 are used to grip the container and to slidingly move interior member 21 with respect to exterior member 11. Projections 15 and 25 also provide a means for preventing the container from being set down unless it is in a closed position. Projection 15 is shaped such that the container cannot be placed on a flat horizontal surface, resting upon projection 15 and end wall 14, without the container tipping over. Projection 25 has the same shape as projection 15. When the container is in an open position (FIG. 2), projection 25 projects sufficiently far from lip 17 such that the container cannot be placed on a flat horizontal surface, resting upon projection 25 and lip 17, without the container tipping over. When the container is in a closed position (FIG. 1), projection 25 is fully contained within the recess defined by exterior member side wall 12 and therefore the container can be set down on lip 17 without tipping over.

Lip 17 is attached to exterior member 11 and extends in an inwardly direction from the exterior of side wall 12. In this manner, interior member 21 is prevented from being removed from the recess defined by exterior member 11.

When apertures 13 and 23 are registered, access to the interior of container 10 is obtained and the contents may be removed. By shaking the container, pills fall out one by one through the registered apertures. The shape of apertures 13 and 23 is circular and this conforms to the shape of round pills. However, the shape of apertures 13 and 23 for any particular container of the present invention should preferably be selected so as to conform to the shape of the pills being contained. In this manner the removal of pills from the container one at a time is assured.

Due to the fact that the physical effort required to use the safety container of the present invention is minimal, it can be easily utilized by elderly people and those with arthritic conditions. Because the pills emerge one by one, the output can be readily controlled and as a result it is unlikely that pills will be dropped or lost. Because the safety container of the present invention functions through feeling rather than through sight, the safety container can be used by the blind without the hazard of spilling and may be used in the darkness equally well. Because the container must be closed before it can be set down without tipping over, the container is safeguarded against being accidentally left open.

Safety container 10 may be constructed from a variety of materials, but a thermoforming or thermosetting plastic is preferred due to such desirable aspects as low cost, light weight and ease of fabrication. It is also envisioned that the cost of such containers can be quite low when produced in quantities that the containers, although refillable, could be treated as disposable.

While there have been described above the principles of this invention in connection with specific apparatus, it is to be clearly understood that this description is made only by way of example and not as a limitation to the scope of the invention.

What is claimed is:

1. A safety container for containing and dispensing particulate matter such as pills and the like, said container comprising:

(a) An exterior member including an end wall, and including a cylindrical side wall defining an exterior side wall aperture;

(b) an interior member including a cylindrical side wall defining an interior side wall aperture, the cylindrical side wall of said interior member being concentric with an slidably engaged in both a longitudinal and a transverse direction with the cylindrical side wall of said exterior member such that said two apertures can be registered with each other, said interior member further including an end wall which is oppositely disposed to the end wall of said exterior member;

(c) grasping means for slidably moving said interior member with respect to said exterior member, said grasping means including a first projection from the end wall of said interior member, and a second projection from the end wall of said exterior member;

(d) means for preventing said container from being set down when said two apertures are in registration, said means including said first projection being dimensioned such that the placement of said container on a flat horizontal surface, with said container resting upon said first projection and said exterior member, is prevented without said container tipping over, said means further including said second projection extending beyond the side wall of said exterior member when said apertures are in registration, to prevent, in combination with said first projection, said container from being placed in an upright position upon a flat horizontal surface without said container tipping over; and (e) in which said interior member is slidably movable to a fully closed position in which said second projection is fully contained within a recess defined by said side wall of said exterior member.

2. The safety container of claim 1 in which one of said members additionally includes a recessed slotted portion in its side wall surface and in which said other of said members includes a boss which protrudes from its side wall surface such that when said one of said members is slidingly moved with respect to the other of said members, said boss follows a path defined by said recessed slotted portion.

3. The safety container of claim 2 in which said recessed slotted portion contains at least two longitudinal portions and a transverse portion.

4. The safety container of claim 2 in which said recessed slotted portion contains at least two turning portions of at least 60 degrees.

5. The safety container of claim 2 in which said exterior member is said member having said recessed slotted portion and said interior member is said member having said boss.

6. The safety container of claim 1 in which said projections are shaped in the form of a half disc and have their diametric edges attached to their respective end wall surfaces.

7. The safety container of claim 1 additionally comprising a lip which extends in an inward direction from the exterior of said side wall of said exterior member such that said interior member is prevented from being removed from within said exterior member.

8. A safety container for containing and dispensing particulate matter such as pills and the like said container comprising:

(a) a first member having a substantially cylindrical side wall defining a first side wall aperture;

(b) a second member having a storage chamber, and a substantially cylindrical side wall surrounding said chamber, and defining a second side wall aperture, said second member being concentric with and slidably received by said first member;

(c) engaging means for controlling movement of one member with respect to the other member between a closed condition of said container wherein said apertures are out of registration with each other, and an open condition wherein said apertures are concentric with each other providing access to said chamber;

(d) grasping means including two oppositely disposed axial projections, one of said projections being attached to said first member and the other of said projections being attached to said second member; and (e) means for preventing said container from being set down in an open condition, said means including said second member projection being fully contained within a recess defined by said first member side wall when said container is in said closed condition, and projecting outside of said recess when said container is in said open condition.

9. The safety container of claim 8 in which said engaging means includes a recessed slotted portion on the side wall surface of one of said members and a boss protruding from the side wall of said other of said members such that when said one of said members is slidingly moved with respect to the other of said members, said boss follows a path defined by said recessed slotted portion.

10. The safety container of claim 9 in which said recessed slotted portion contains at least two longitudinal portions and a transverse portion.

* * * * *